US009278461B2

(12) United States Patent
Lin

(10) Patent No.: US 9,278,461 B2
(45) Date of Patent: Mar. 8, 2016

(54) CORNER TRIMMER

(71) Applicant: Aidox Technology Corporation, Taichung (TW)

(72) Inventor: Chien-Fu Lin, Taichung (TW)

(73) Assignee: Aidox Technology Corporation, Xitun Dist. Taichung (TW)

( * ) Notice: Subject to any disclaimer, the term of this patent is extended or adjusted under 35 U.S.C. 154(b) by 239 days.

(21) Appl. No.: 14/056,037

(22) Filed: Oct. 17, 2013

(65) Prior Publication Data

US 2015/0107431 A1 Apr. 23, 2015

(51) Int. Cl.

| | |
|---|---|
| ***B26D 5/08*** | (2006.01) |
| ***B26F 1/14*** | (2006.01) |
| ***B26D 3/10*** | (2006.01) |
| ***B26D 5/10*** | (2006.01) |
| ***B26D 7/20*** | (2006.01) |
| ***B26D 7/26*** | (2006.01) |
| *B26D 1/00* | (2006.01) |

(52) U.S. Cl.

CPC ... *B26F 1/14* (2013.01); *B26D 3/10* (2013.01); *B26D 5/10* (2013.01); *B26D 7/20* (2013.01); *B26D 7/2614* (2013.01); *B26D 2001/006* (2013.01); *B26D 2001/0066* (2013.01); *Y10T 83/8785* (2015.04)

(58) Field of Classification Search

CPC ..... B26D 2001/006; B26D 2001/0066; B26D 3/10; B26D 5/10; B26D 7/20; B26D 7/2614; Y10T 83/8809; Y10T 83/885; Y10T 83/8786; B26F 1/12; B26F 1/14

See application file for complete search history.

(56) References Cited

U.S. PATENT DOCUMENTS

| | | | | |
|---|---|---|---|---|
| 6,016,733 | A * | 1/2000 | Lin | 83/589 |
| 6,840,145 | B1 * | 1/2005 | Lee | 83/167 |
| 2005/0028659 | A1 * | 2/2005 | Lin | 83/167 |
| 2005/0279201 | A1 * | 12/2005 | Chang | 83/589 |

* cited by examiner

*Primary Examiner* — Stephen Choi
(74) *Attorney, Agent, or Firm* — Charles E. Baxley

(57) ABSTRACT

A corner trimmer includes a base, a bottom blade, an L-shaped operation member, a top blade and a spring. The base has a platform and a pivotal portion. The bottom blade having a round edge is fixed to the base and parallel to the platform. The two ends of the L-shaped operation member and two ends of the pivot of the pivotal portion are connected to the base. The L-shaped operation member has an opening. The top blade is located at the inside of the L-shaped operation member and has a curved edge which is located corresponding to the round edge of the bottom blade and shaped to be complementary to the round edge. The spring is biased between the base and the top blade. The corner of an object is inserted into the opening and trimmed by the alternative top and bottom blades.

6 Claims, 8 Drawing Sheets

CORNER TRIMMER

FIELD OF THE INVENTION

The present invention relates to a manual cutting tool, and more particularly, to a corner trimmer.

BACKGROUND OF THE INVENTION

In order to prevent paper-cut by sharp corners of business cards, paper sheets or even laminated cards, the corners of these products are rounded by using scissors to cut the sharp corners off. However, it takes a lot of time to round the corners one by one, and the rounded corners are difficult to be identical. Besides, the operation of scissors has potential risk, especially for children. The corner trimmers are then developed which can quickly cut the corners and the corners are trimmed identically.

Taiwan Patent Application No. 085211808 discloses a corner trimmer having a fixed blade and a moveable blade, wherein the fixed blade has a first slot for accommodating the product, such as business card, and the moveable blade can be inserted into a second slot in the fixed blade. The first and second slots are perpendicular to each other. A fixed cutting edge is formed at the intersection portion between the first and second slots. A first cutting edge and a second cutting edge are formed at the lower portion of the moveable blade. The radius of the first cutting edge is larger than the radius of the rounded corners.

Taiwan Patent Application No. 085219081 discloses a corner trimmer having a sub-blade at the corner of the body of the trimmer, a main blade is connected to the body and located corresponding to the sub-blade. Each of the main blade and the sub-blade has a round cutting edge and the two respective round cutting edges are located alternatively to each other. A spring biases the main blade to keep the two respective round cutting edges to be alternative to each other. The corner of the card is inserted between the two respective round cutting edges to be cut.

However, these two conventional corner trimmers can only create a specific round corner which is boring and cannot satisfy different requirements to the cards, paper sheets and posters.

the present invention intends to provide a corner trimmer which improves the shortcomings mentioned above.

SUMMARY OF THE INVENTION

The present invention relates to a corner trimmer and comprises a base having a platform and a pivotal portion. The pivotal portion has two oval holes located on two sides of the base. A pivot extends through the base, and two ends of the pivot extend through the two oval holes. A spring shaft extends through the base, and two ends of the spring shaft are fixed to the base. A resilient member is mounted to the spring shaft and the two ends of the resilient member contact the inside of the base and the pivot respectively. A bottom blade is fixed to the base and parallel to the platform. The bottom blade has a round edge. An L-shaped operation member has two ends which are fixed to the two ends of the pivot of the pivotal portion of the base. The L-shaped operation member has an opening. A top blade is located at the inside of the L-shaped operation member and has a curved edge which is located corresponding to the round edge of the bottom blade. Two respective shapes of the round edge and the curved edge are complementary to each other. A spring is biased between the inside of the base and the underside of the top blade to keep the top blade and the bottom blade to be alternative to each other. The opening of the L-shaped operation member and the platform of the base are respectively located on two opposite sides of the alternation between the top blade and the bottom blade. The corner of an object is inserted into the opening and trimmed by the alternative top and bottom blades.

Preferably, two stop edges are located on two respective insides of the opening of the L-shaped operation member. The two stop edges extend to the inside of the L-shaped operation member.

Preferably, two instruction lines are located on a surface of the L-shaped operation member and located corresponding to the two stop edges.

Preferably, two stop walls are located on two sides of the platform of the base.

Preferably, each of two arms of the L-shaped operation member has a top contact portion which contacts an underside of the stop wall corresponding thereto so as to stop the L-shaped operation member at a final end of an upward movement track of the L-shaped operation member.

Preferably, the base has a contact portion extending from the front top thereof and the L-shaped operation member is stopped by the contact portion when pivoting downward and contacting the contact portion.

Preferably, a bottom cover is mounted to the underside of the base so as to be adapted to accept debris.

The primary object of the present invention is to provide a corner trimmer which allows the object to be cut to be inserted into the trimmer in different directions. The corners of the object to be cut can be cut into round corners or curved recesses, or other shapes when needed.

The present invention will become more obvious from the following description when taken in connection with the accompanying drawings which show, for purpose of illustration only, a preferred embodiment in accordance with the present invention.

DETAILED DESCRIPTION OF THE PREFERRED EMBODIMENT

Figure 1:
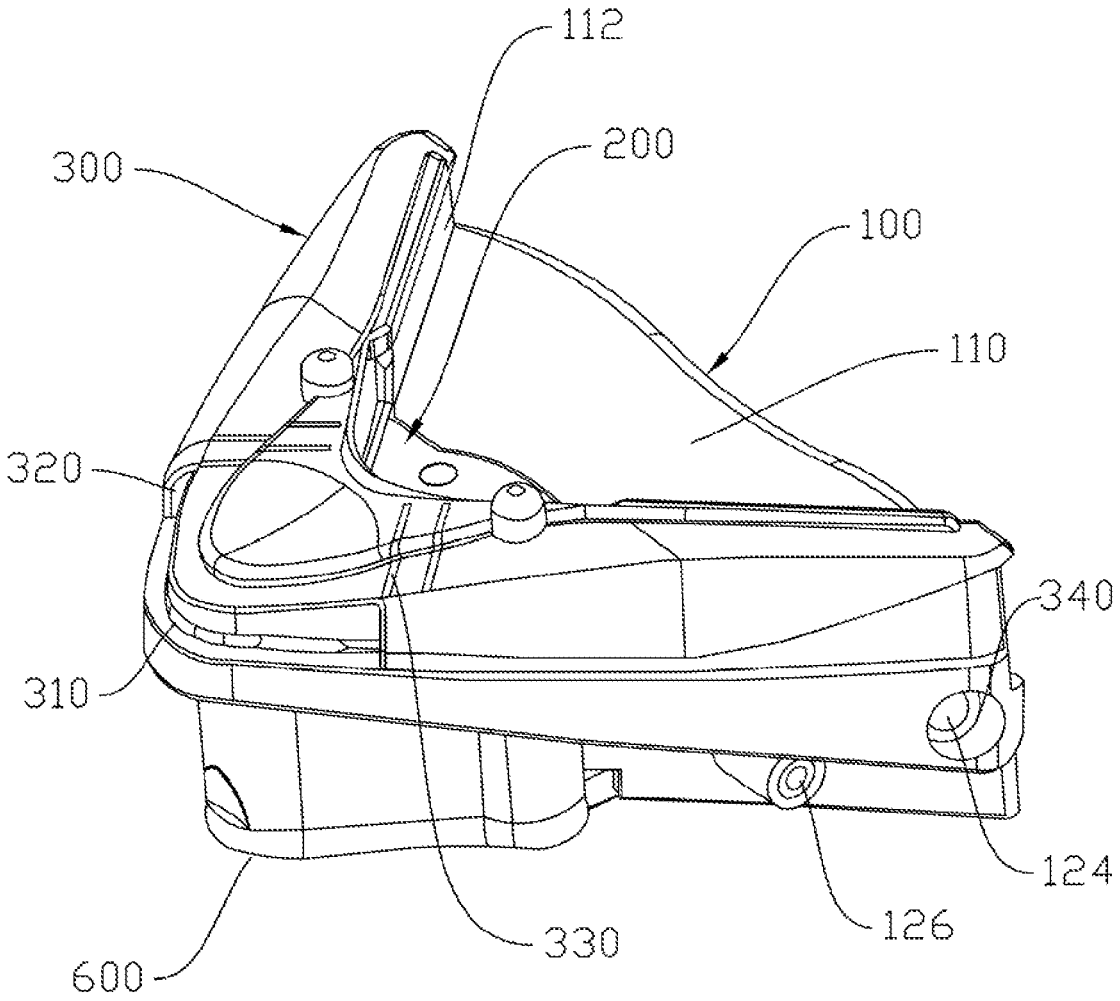
FIG. 1 is a perspective view to show the corner trimmer of the present invention.
Figure 2:
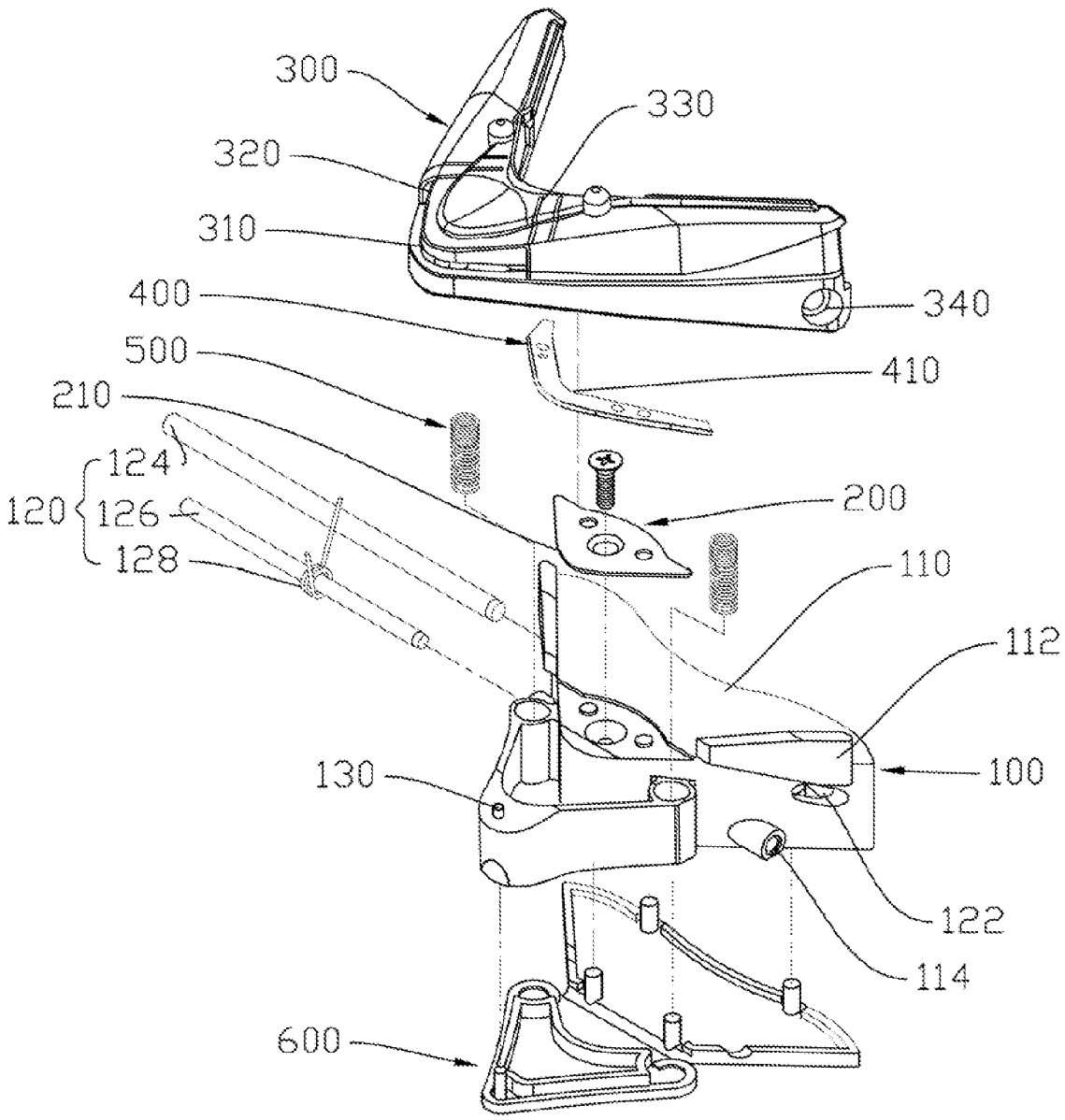
FIG. 2 is an exploded view to show the corner trimmer of the present invention.

Referring to FIGS. 1 and 2, the corner trimmer of the present invention comprises a base 100, a bottom blade 200, an L-shaped operation member 300, a top blade 400, a spring 500 and a bottom cover 600.

The base 100 is a substantially triangular body and has a platform 110 and a pivotal portion 120. Two stop walls 112 are located on two sides of the platform 110 of the base 100. The object to be cut is put on the platform 110 and the two sides of the object to be cut are contact against the two stop walls 112 so as to adjust the angle and direction to ensure the trimmings are made identically every time.

Figure 3:
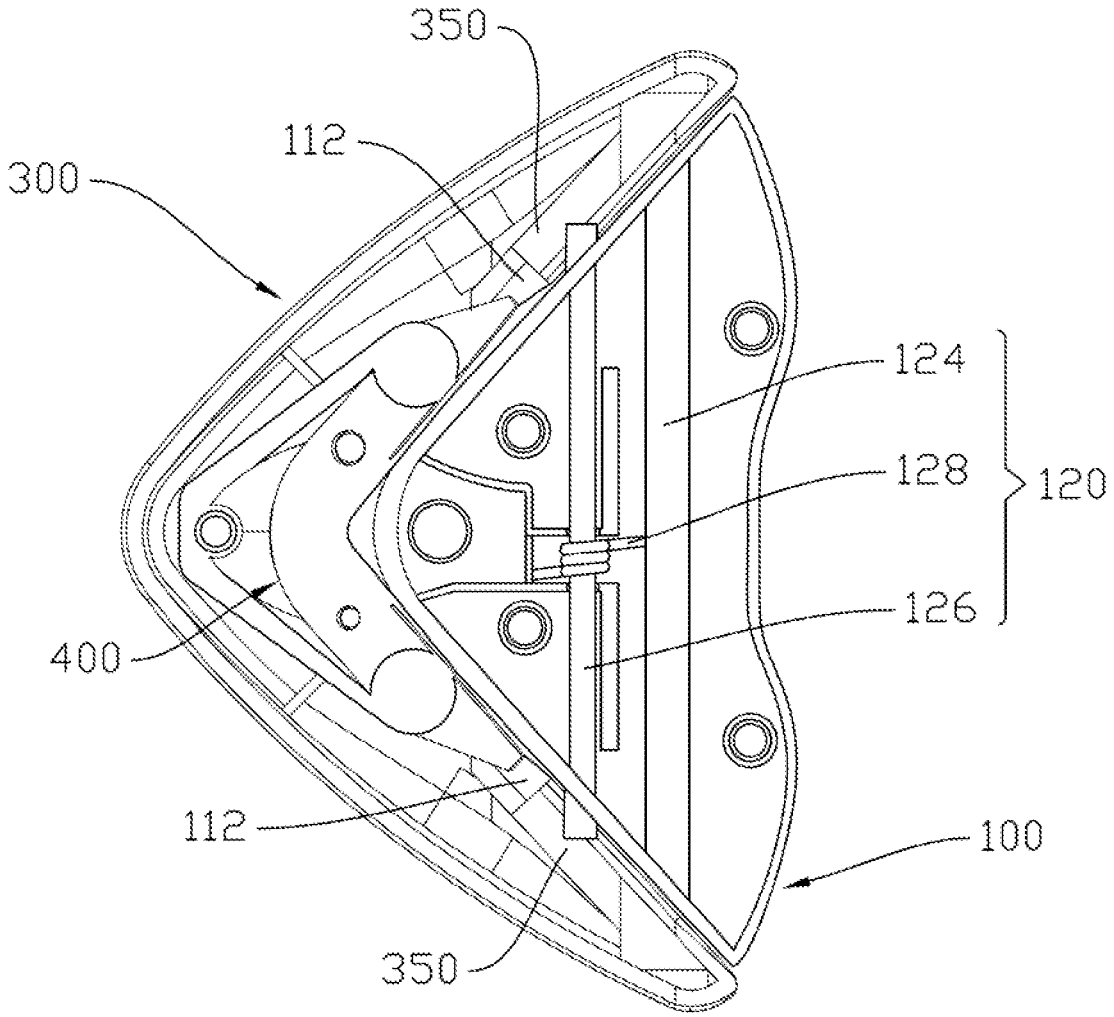
FIG. 3 is a bottom view, without the bottom cover, of the corner trimmer of the present invention.
Figure 4:
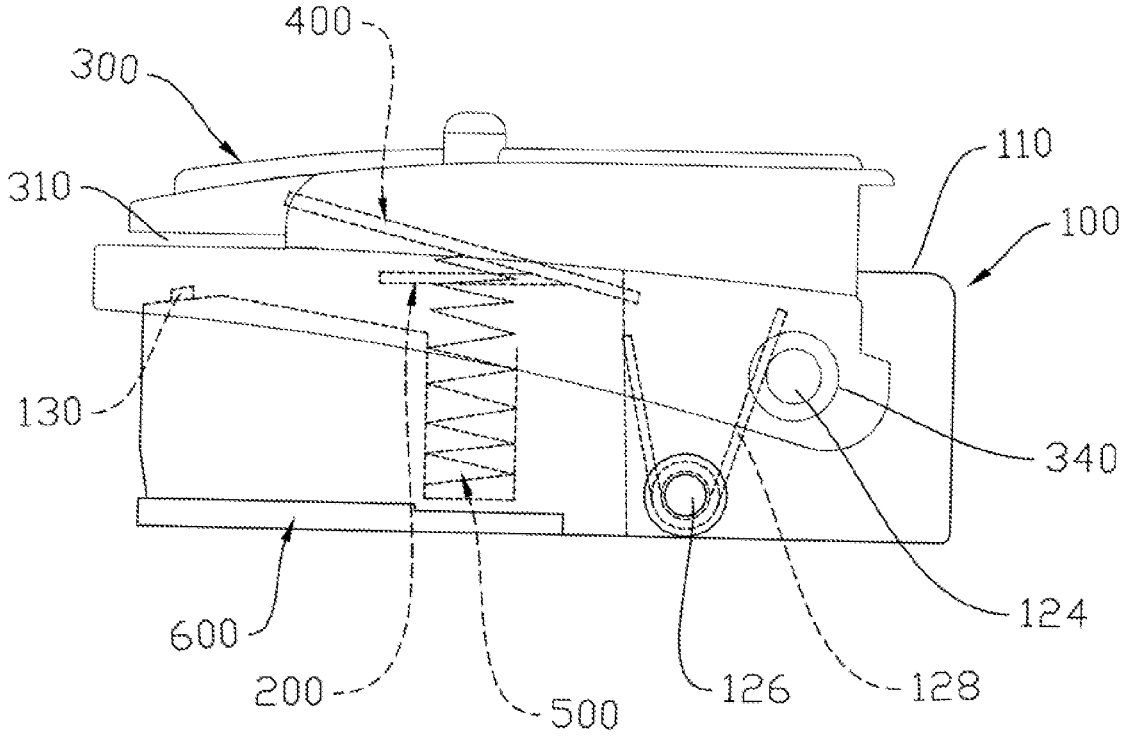
FIG. 4 is a side view to show the corner trimmer of the present invention.

As shown in FIGS. 2 to 4, the base 100 has the pivotal portion 120 so that the L-shaped operation member 300 is pivotably connected to the base 100 by the pivotal portion 120. The pivotal portion 120 has two oval holes 122 located on two sides of the base 100, a pivot 124, a spring shaft 126 and a resilient member 128. The two ends of the pivot 124 extend through the two oval holes 122 so as to be connected to the two ends of the L-shaped operation member 300. The spring shaft 126 extends through the base 100, and two ends of the spring shaft 126 are fixed to the base 100. In one embodiment, the base 100 has two reception holes 114 defined in the two sides of the base 100, and the two ends of the spring shaft 126 are fixed in the reception holes 114. The resilient member 128 is mounted to the spring shaft 126 and the two ends of the resilient member 128 contact the inside of the base 100 and the pivot 124 respectively. The pivot 124 is positioned by the resilient member 128 and the two ends of the L-shaped operation member 300 are allowed to move back and forth by the oval holes 122 and the pivot 124 when the L-shaped operation member 300 is operated. Therefore less resistance is applied to the user when operating the L-shaped operation member 300.

As shown in FIGS. 1 and 2, the bottom blade 200 is fixed to the base 100 and parallel to the platform 110. The bottom blade 200 has a round edge 210.

Figure 5A:
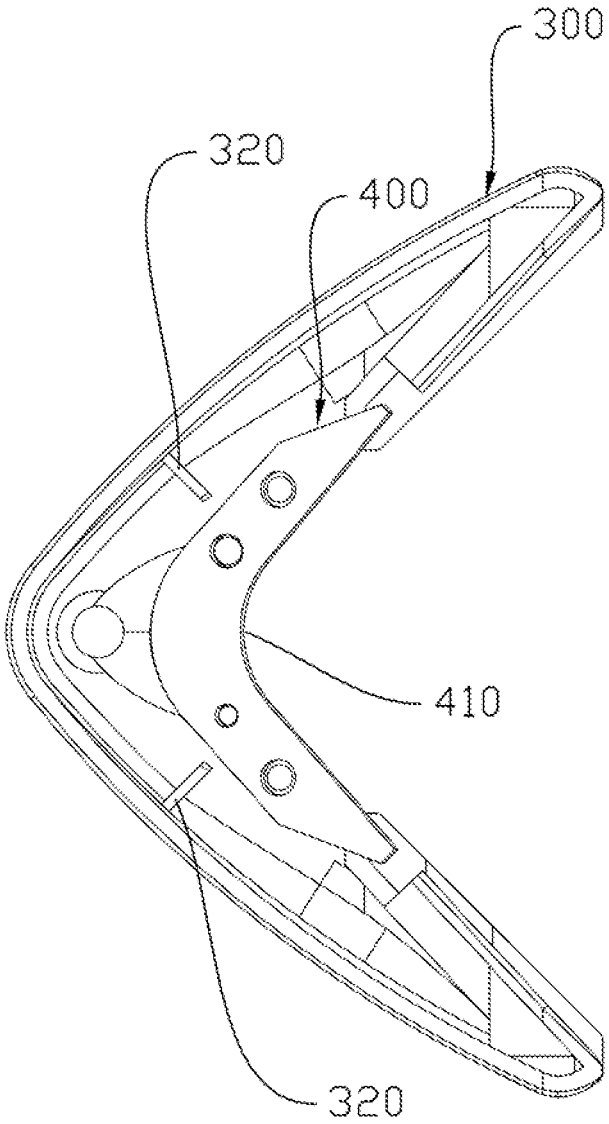
FIG. 5A shows the bottom view of the L-shaped operation member of the corner trimmer of the present invention.
Figure 5B:
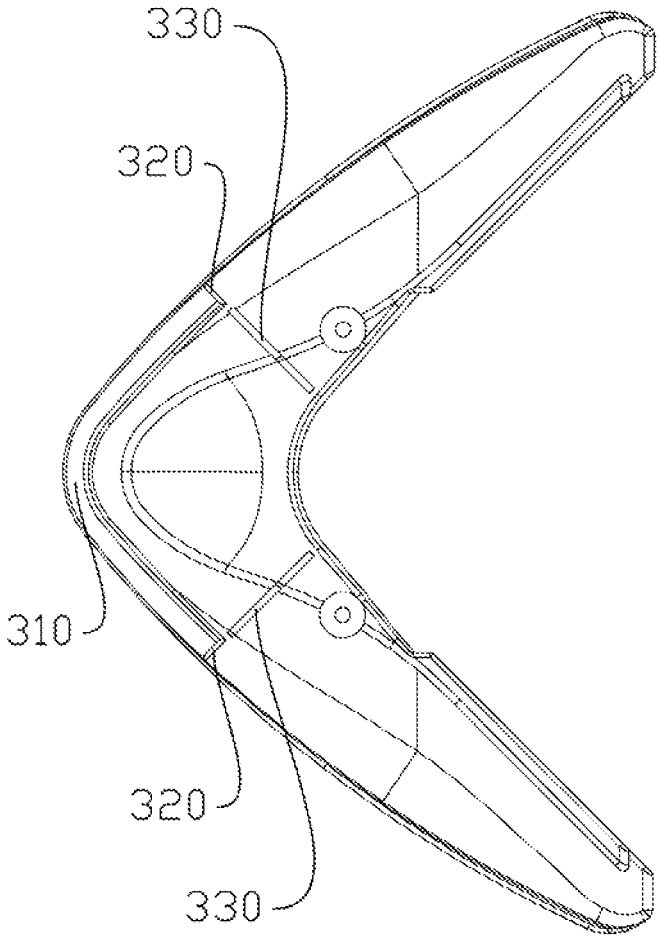
FIG. 5B shows the top view of the L-shaped operation member of the corner trimmer of the present invention.

The two ends of the L-shaped operation member 300 are pivotably connected to the base 100 by the pivotal portion 120 of the base 100. The L-shaped operation member 300 has an opening 310. As shown in FIGS. 5A and 5B, two stop edges 320 are located on two respective insides of the opening 310 of the L-shaped operation member 300. The two stop edges 320 extend to the inside of the L-shaped operation member 300. Two instruction lines 330 are located on the surface of the L-shaped operation member 300 and located corresponding to the two stop edges 320. When the object to be cut is inserted into the opening 310, the two sides of the object to be cut are located in alignment with the two stop edges 320, so a to adjust the angle and direction to ensure the trimmings are made identically every time. The instruction lines 330 allow the user to check the positions of the two sides of the object to be cut. As shown in FIGS. 2, 5A and 5B, the two arms of the L-shaped operation member 300 have the same length, two fixing holes 340 are respectively defined in two respective distal ends of the two arms. The two ends of the pivot 124 are fixed to the fixing holes 340 to let the two ends of the L-shaped operation member 300 to be pivotably connected to two sides of the base 100.

The top blade 400 is located at the inside of the corner portion of the L-shaped operation member 300 and has a curved edge 410 which is located corresponding to the round edge 210 of the bottom blade 200. The two respective shapes of the round edge 210 and the curved edge 410 being complementary to each other. The two ends of the L-shaped operation member 300 are allowed to move back and forth by the oval holes 122 and the pivot 124 when the L-shaped operation member 300 is operated. Therefore, the curved edge 410 and the round edge 210 are located so as to perform as scissors to trim the corners of the object to be cut.

As shown in FIG. 4, the two ends of the spring 500 are biased between the inside of the base 100 and the underside of the top blade 400 so as to keep the top blade 400 and the bottom blade 200 to be alternative to each other. As shown in FIGS. 1, 3 and 4, the base 100 has a contact portion 130 extending from the front top thereof and the L-shaped operation member 300 is topped by the contact portion 130 when the L-shaped operation member 300 is pivoted downward to trim the object to be cut and contacts the contact portion 130. Besides, each of two arms of the L-shaped operation member 300 has a top contact portion 350 which contacts the underside of the stop wall 112 corresponding thereto so as to stop the L-shaped operation member 300 at the final end of the upward movement track of the L-shaped operation member 300 when the user releases the L-shaped operation member 300 after trimming action.

The opening 310 of the L-shaped operation member 300 and the platform 110 of the base 100 are respectively located on two opposite sides of the alternation position between the top blade 400 and the bottom blade 200. Therefore, the corner of the object to be cut can be fed via the platform 110 of the base 100, or from the opening 310 of the L-shaped operation member 300.

A bottom cover 600 is mounted to an underside of the base 100 so as to accept and store the debris in the base 100.

Figure 6A:
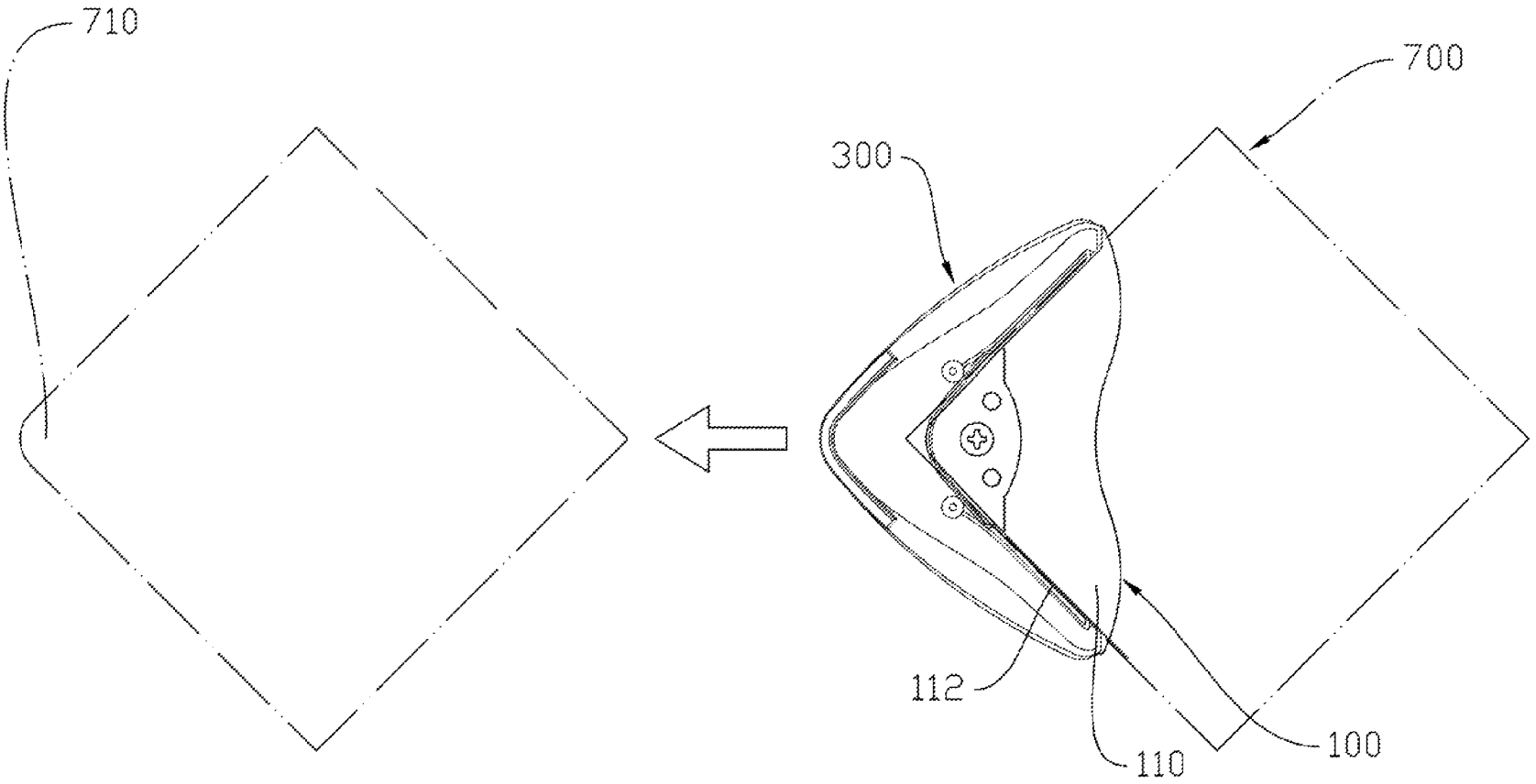
FIG. 6A shows a card is inserted from the front end of the corner trimmer of the present invention.

As shown in FIGS. 6A and 4, when the corner 710 of the object 700 is put on the platform 110 of the base 100, the two sides of the object 700 are aligned with the stop walls 112 to adjust the direction, angle and position to position the corner 710 at the correct position between the top blade 400 and the bottom blade 200. The L-shaped operation member 300 is then pivoted downward, to let the top and bottom blade 400, 200 to move toward each other trim the corner 710 to be a round corner.

Figure 6B:
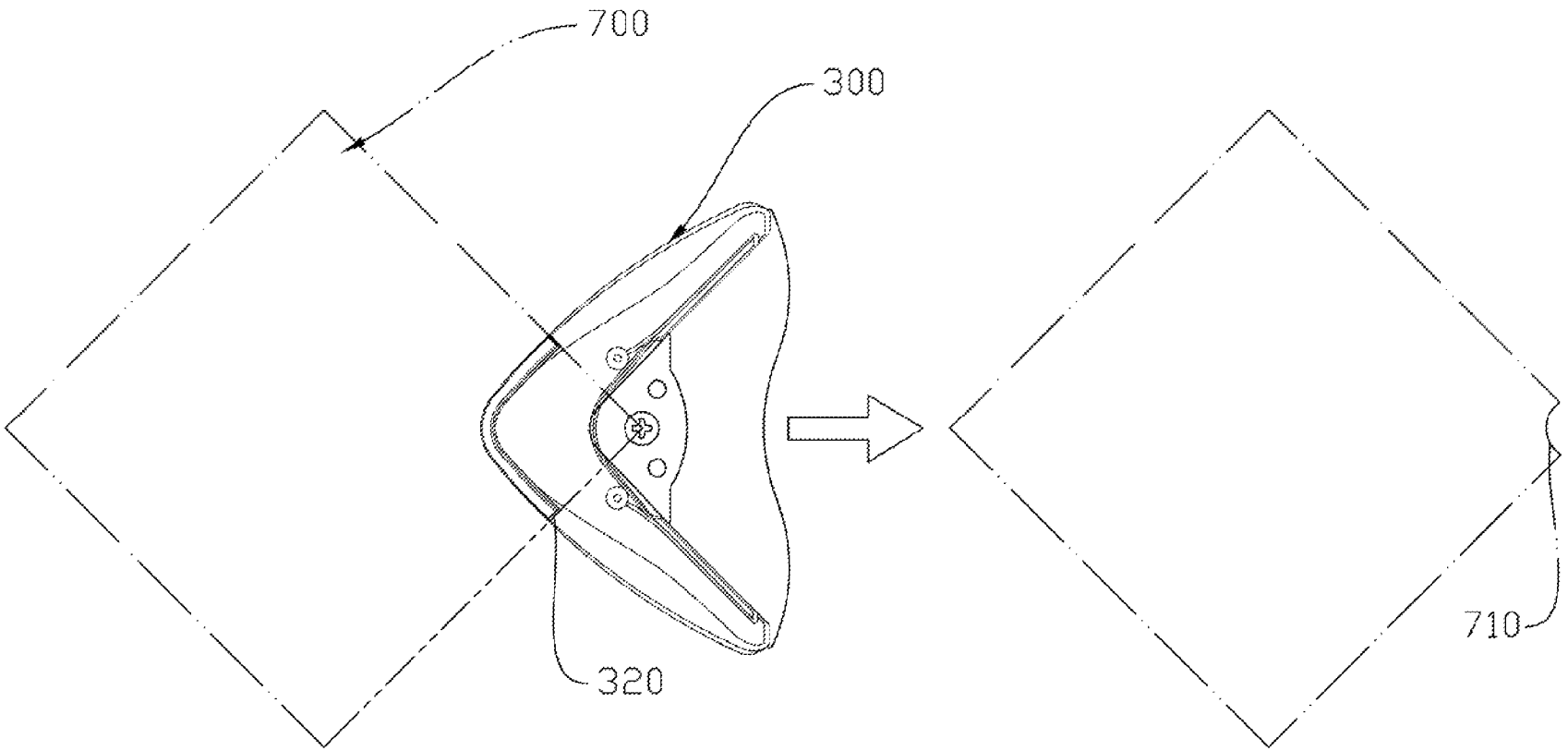
FIG. 6B shows a card is inserted from the rear end of the corner trimmer of the present invention.

As shown in FIGS. 6B and 4, when the corner 710 of the object 700 is inserted from the opening 310, the two sides of the object 700 are aligned with the stop edges 320 to adjust the direction, angle and position to position the corner 710 at the correct position between the top blade 400 and the bottom blade 200. The L-shaped operation member 300 is then pivoted downward, to let the top and bottom blade 400, 200 to move toward each other trim the corner 710 to be round corner.

The present invention allows the user to insert the corner 710 of the object 700 to be cut from different directions to be cut by the top blade 400 and the bottom blade 200. The corners 710 of the object 700 to be cut can be cut into round corners or curved recesses, or other shapes when needed.

While we have shown and described the embodiment in accordance with the present invention, it should be clear to those skilled in the art that further embodiments may be made without departing from the scope of the present invention.

What is claimed is:

1. A corner trimmer comprising:

a base having a platform and a pivotal portion, the pivotal portion having two oval holes located on two sides of the base;

a pivot extending through the base, two ends of the pivot extending through the two oval holes;

a spring shaft extending through the base, two ends of the spring shaft fixed to the base;

a resilient member mounted to the spring shaft and two ends of the resilient member contacting an inside of the base and the pivot respectively;

a bottom blade fixed to the base and being parallel to the platform, the bottom blade having a round edge;

an L-shaped operation member having two ends which are fixed to the two ends of the pivot of the pivotal portion of the base, the L-shaped operation member having an opening defined in an outside thereof, two stop edges located on two respective insides of the opening of the L-shaped operation member, the two stop edges extending toward the inside of the L-shaped operation member;

a top blade located at an inside of the L-shaped operation member and having a curved edge which is located corresponding to the round edge of the bottom blade, two respective shapes of the round edge and the curved edge being complementary to each other, and a spring biased between the inside of the base and an underside of the top blade so as to keep the top blade and the bottom blade to be alternative to each other, wherein a corner of an object to be cut is fed via the platform of the base and trimmed into a protruded and rounded corner, or from the opening of the L-shaped operation member and trimmed into a recessed and rounded corner.

2. The round trimmer as claimed in claim 1, wherein two instruction lines are located on a surface of the L-shaped operation member and located corresponding to the two stop edges.

3. The round trimmer as claimed in claim 1, wherein two stop walls are located on two sides of the platform of the base.

4. The round trimmer as claimed in claim 3, wherein each of two arms of the L-shaped operation member has a top contact portion which contacts an underside of the stop wall corresponding thereto so as to stop the L-shaped operation member at a final end of an upward movement track of the L-shaped operation member.

5. The round trimmer as claimed in claim 1, wherein the base has a contact portion extending from a front top thereof and the L-shaped operation member is stopped when pivoting downward and contacting the contact portion.

6. The round trimmer as claimed in claim 1, wherein a bottom cover is mounted to an underside of the base so as to be adapted to accept debris.

* * * * *